United States Patent [19]

Anderson

[11] Patent Number: 5,024,437

[45] Date of Patent: Jun. 18, 1991

[54] GOLF CLUB HEAD

[75] Inventor: Donald A. Anderson, Huntington Beach, Calif.

[73] Assignee: Gear Fit Golf, Inc., Huntington Beach, Calif.

[21] Appl. No.: 492,973

[22] Filed: Mar. 13, 1990

Related U.S. Application Data

[63] Continuation-in-part of Ser. No. 364,698, Jun. 12, 1989, abandoned.

[51] Int. Cl.[5] ..... A63B 53/04

[52] U.S. Cl. ..... 273/78; 273/173

[58] Field of Search ..... 273/78, 167 J, 173, 273/167 R–167 H, 169

[56] References Cited

U.S. PATENT DOCUMENTS

| | | | |
|---|---|---|---|
| 1,257,471 | 2/1918 | Fitzjohn et al. | 273/173 |
| 1,359,220 | 11/1920 | Beamer | 273/78 |
| 1,589,363 | 6/1926 | Butchart | 273/173 |
| 1,665,523 | 4/1928 | Boyle | 273/173 X |
| 2,034,936 | 3/1936 | Barnhart | 273/173 X |
| 2,447,967 | 8/1948 | Stone | 273/78 |
| 3,387,844 | 6/1968 | Shippee | 273/78 X |
| 4,252,262 | 2/1981 | Igarashi | 273/173 X |
| 4,398,965 | 8/1983 | Campau | 273/78 X |
| 4,438,931 | 3/1984 | Motomiya | 273/167 H |
| 4,749,197 | 6/1988 | Orlowski | 273/173 |
| 4,792,140 | 12/1988 | Yamaguchi et al. | 273/78 X |

FOREIGN PATENT DOCUMENTS

| | | | |
|---|---|---|---|
| 211781 | 12/1957 | Australia | 273/167 F |
| 3822 | of 1893 | United Kingdom | 273/78 |
| 15376 | of 1903 | United Kingdom | 273/167 J |
| 15260 | of 1905 | United Kingdom | 273/78 |
| 267755 | 3/1927 | United Kingdom | 273/173 |
| 379032 | 8/1932 | United Kingdom | 273/78 |

OTHER PUBLICATIONS

"Golf Digest" Magazine, (Jan. 1975 issue).

*Primary Examiner*—Edward M. Coven
*Assistant Examiner*—Sebastiano Passaniti
*Attorney, Agent, or Firm*—William W. Haefliger

[57] ABSTRACT

A golf club head has a main body portion formed by investment casting of material such as stainless steel, beryllium copper, titanium, or aluminum. The face plate of the head is formed of a forged metal such as forged carbon steel, this plate being welded to the face portion of the casting to form an integral assembly therewith. The forged metal faceplate affords a more solid impact and feel to the club which provides better control.

1 Claim, 2 Drawing Sheets

GOLF CLUB HEAD

This application is a continuation in part of application No. 364,698 for a Golf Club Head filed June 12, 1989, now abandoned, of which I am a co-inventor and owner of the entire interest by assignment.

BACKGROUND OF THE INVENTION

1. Field of the Invention

This invention relates to golf clubs and more particularly to an improved face plate construction for a golf club head.

2. Description of the Prior Art

The heads of golf clubs are generally formed in a one piece casting of durable materials such as stainless steel, beryllium copper, aluminum, etc. A head of this type is described in U.S. Pat. No. 4,021,047 issued May 3rd, 1977 to R.J. Mader. The use of face plates made of a different material than that of the main body of the club head has been used in the prior art in both irons and "wood" type drivers which are often made of cast metal. Such prior art club heads are described in U.S. Pat. No. 4,792,140 issued Dec 20, 1988 to Yamaguchi, et al.; U.S. Pat. No. 4,534,558 issued Aug. 13, 1985 to Yoneyama; U.S. Pat. No. 3,218,072 issued Nov. 16, 1965 to Burr; and British patent no. 1.227.948 issued Apr. 15, 1971 to Haines, et al. In the heads of all of these prior art patents, the face plate is of a plastic material such as a resin or a carbon fiber composite. It has been found that the use of a forged metal for the face plate of the club head results in a more solid impact and feel which provides better control. However, forged metal is not amenable to casting which mitigates against its use for forming the entire head. Also forged metal tends to have a high density which would make for a club head having excessive weight.

SUMMARY OF THE INVENTION

The golf club head of the present invention provides an improvement over prior art heads in that it utilizes a face plate of forged metal. This end result is achieved without greatly increasing the cost or weight of the driving head by forming the main body of the head in an investment casting of a material such as stainless steel, beryllium copper, titanium, or aluminum and then attaching a face plate of a forged metal selected from the class consisting of forged carbon steel, forged stainless steel, forged beryllium copper, and forged titanium by suitable means such as welding.

It has been found that forged metal face plates have an inherently greater strength than cast metal face plates with a more uniform hardness over the hitting area of the plate. This is in view of the low porosity, high density and homogeneous grain structure of such a material which makes for a more solid plate. On the other hand, cast metal is desirable for the main body of the club head in view of its lighter weight which tends to keep down the overall weight of the club head. It is essential that the face plate be solidly attached to the main body of the head by means such as welding to make for a solidly integrated head structure.

It is therefore an object of this invention to provide a golf club head having a face plate of a forged metal which gives solider impact and feel to provide better control;

Other objects of the invention will become apparent as the description proceeds in connection with the accompanying drawings of which:

DETAILED DESCRIPTION OF THE INVENTION

Referring now to FIGS. 1–4, a first embodiment of the invention is illustrated. Face plate 11, which is fabricated of a material selected from the class consisting of forged carbon steel, forged stainless steel, forged berylium copper, and forged titanium, has a lip portion 11*a* formed thereon. The main body 12 of the club head is formed by the investment casting of a material such as stainless steel, beryllium copper, titanium, aluminum etc. Main body portion 12 has a slot 12*a* formed therein and a recessed portion 12*b* which matingly receives face plate 11 with lip portion 11*a* fitting into slot 12*a*. Face plate 11 is solidly integrated with main body portion 12 by weld joints 14 formed along the perimeter of the face plate. In this manner the face plate is solidly integrated with the casting.

Figure 1:
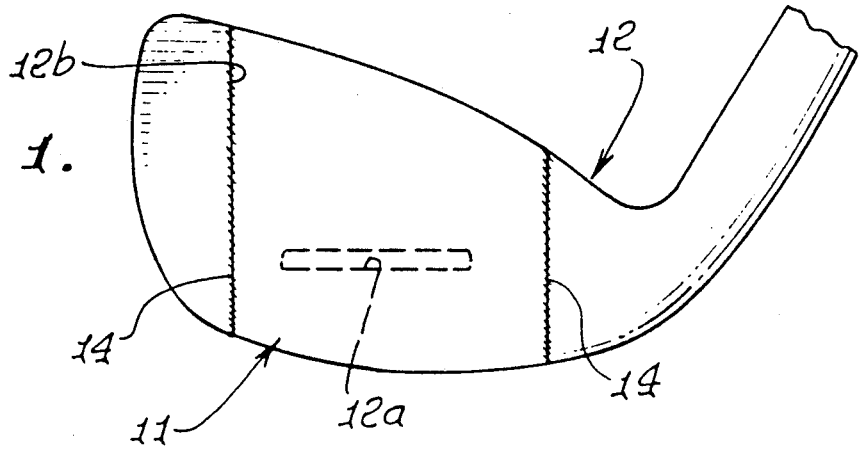
FIG. 1 is a side elevational view of a first embodiment of the invention.
Figure 2:
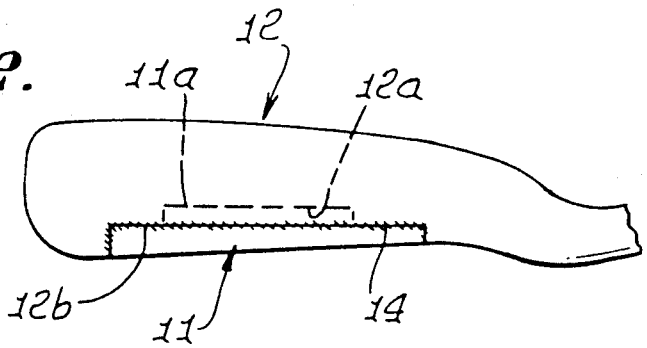
FIG. 2 is a bottom plan view of the first embodiment.
Figure 3:
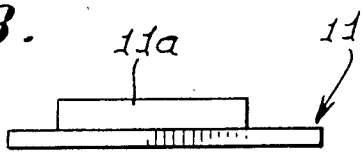
FIG. 3 is a top plan view illustrating the face plate employed in the first embodiment.
Figure 4:
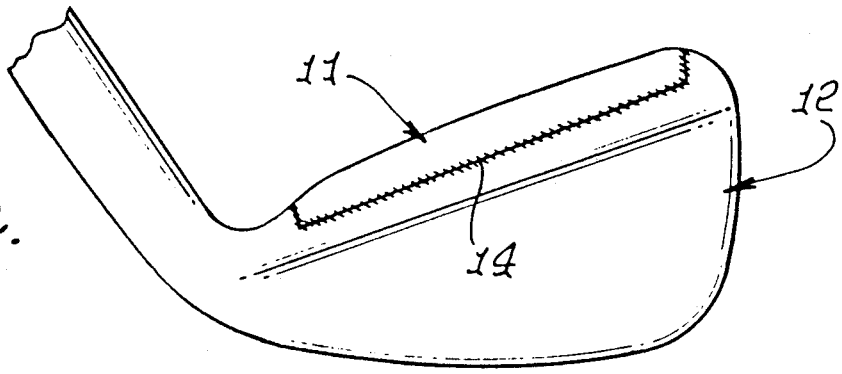
FIG. 4 is a top plan view of the first embodiment.
Figure 5:
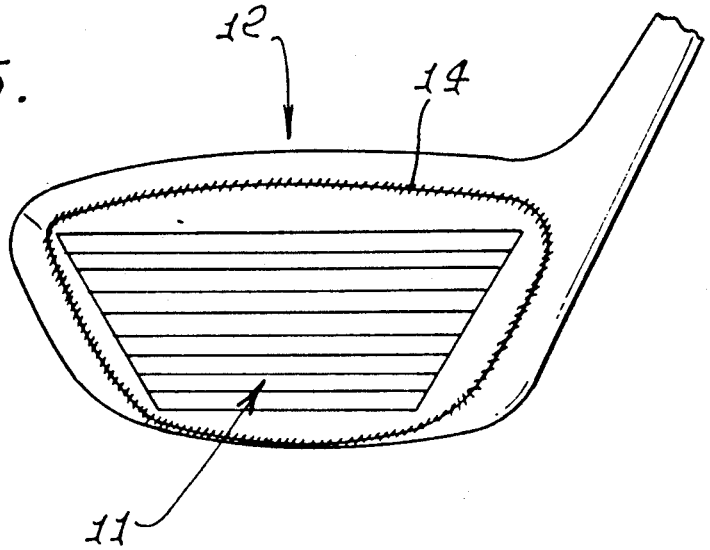
FIG. 5 is a side elevational view of a second embodiment of the invention.
Figure 6:
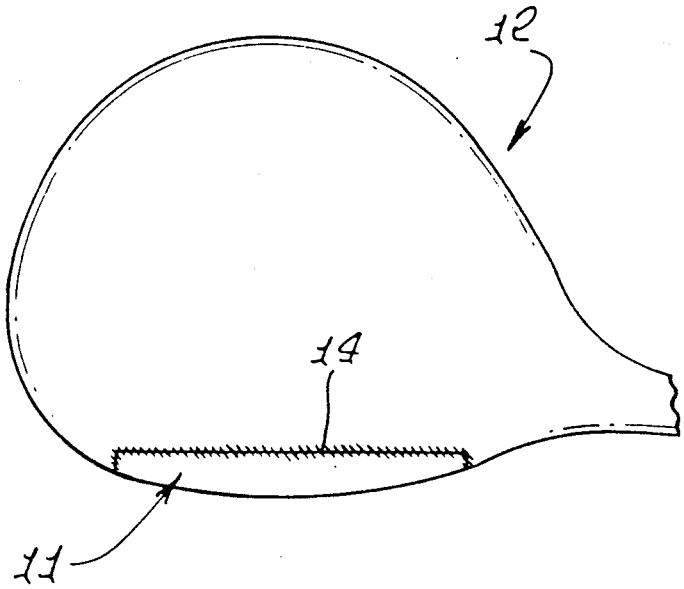
FIG. 6 is a bottom plan view of the second embodiment.
Figure 7:
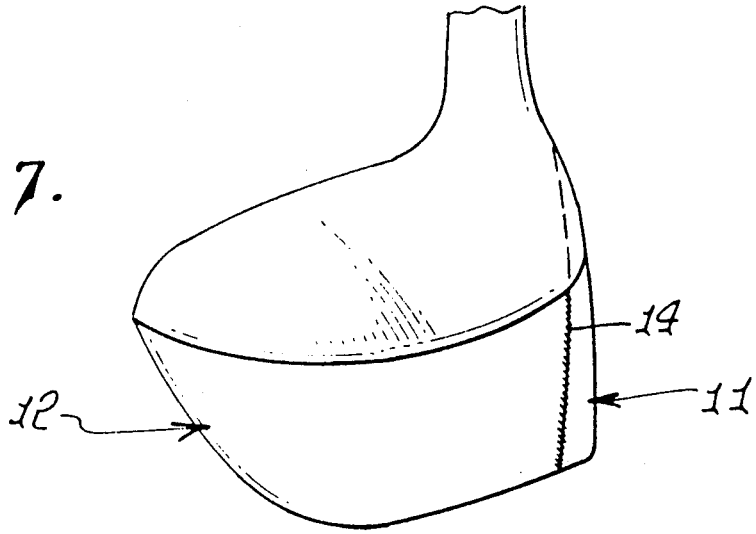
FIG. 7 is a front perspective view of the second embodiment.

Referring now to FIGS. 5–7, a second embodiment of the invention is illustrated, this embodiment being a "wood" type driver. The main body portion 12 as for the previous embodiment is formed by investment casting from a material such as stainless steel, beryllium copper, titanium, aluminum, etc. The face plate 11, as for the previous embodiment is fabricated of forged metal selected from the same class of materials as for the first embodiment. The face plate 11 is abutted against the front surface of the casting and solidly joined thereto along weld joints 14, which run along the perimeter of the face plate thereby integrating the face plate with the casting as is clear from the drawings, the head main body portion has a recessed portion into which the periphery of the face place is fitted, said weld means joining said face plate to said main body portion comprising weld joint structure formed along the periphery of said face plate and welding said face plate periphery to said recessed portion, and said weld means extending along the entire periphery of the face plate in looping configuration, and said weld means and face plate extending to substantially the bottom level of the head. Also the weld means has generally trpezoidal configuration, with top and bottom elongated and curved extents; the top curved extent being upwardly convex, and the bottom curved extent being downwardly convex.

While the invention has been described and illustrated in detail, it is to be clearly understood this intended by way of illustration and example only and is not to be taken by way of limitation, the spirit and scope of the invention being limited only by the terms of the following claims.

I claim:

1. A golf club head comprising:

a) a main body portion formed by a steel casting, b) a face plate formed of forged steel, and having a periphery, and c) weld means joining said periphery of said face plate to said main body portion to form a high strength, forged face plate for said golf club head, d) said main body portion having a recessed portion into which the periphery of the face plate is fitted, said weld means joining said face plate to said main body portion comprising weld joint structure formed along the periphery of said face plate and welding said face plate periphery to said recessed portion, and said weld means extending along the periphery of the face plate in looping configuration, and said weld means and face plate extending substantially to the bottom level of the head, and to the toe and heel of the head, e) said weld means having generally trapezoidal configuration, with top and bottom elongated and curved extents; the top curved extent being upwardly convex, and the bottom curved extent being downwardly convex.

* * * * *